US009242765B2

(12) United States Patent
Oziomek et al.

(10) Patent No.: US 9,242,765 B2
(45) Date of Patent: Jan. 26, 2016

(54) FOOD PRODUCT PACKAGING WITH A HANDLE AND METHODS FOR MAKING THE SAME

(71) Applicant: Perdue Foods LLC, Salisbury, MD (US)

(72) Inventors: Thomas Oziomek, Philadelphia, PA (US); Matthew Hubbard, Hebron, MD (US)

(73) Assignee: PERDUE FOODS LLC, Salisbury, MD (US)

( * ) Notice: Subject to any disclaimer, the term of this patent is extended or adjusted under 35 U.S.C. 154(b) by 474 days.

(21) Appl. No.: 13/682,124

(22) Filed: Nov. 20, 2012

(65) Prior Publication Data

US 2014/0141131 A1 May 22, 2014

(51) Int. Cl.

| | |
|---|---|
| ***B65D 25/28*** | (2006.01) |
| ***B65D 75/32*** | (2006.01) |
| ***B65D 77/20*** | (2006.01) |

(52) U.S. Cl.

CPC ..... *B65D 25/28* (2013.01); *B65D 75/327* (2013.01); *B65D 77/2032* (2013.01); *B65D 2575/3263* (2013.01); *B65D 2575/3272* (2013.01)

(58) Field of Classification Search

CPC ..... B65D 25/28; B65D 25/0802; B65D 25/2873; B65D 25/287; B65D 25/2867; B65D 75/327; B65D 2575/3272; B65D 2575/3263; B65D 2571/00432; B65D 21/0204; B65D 21/0201; A45F 5/1026; A45F 2005/006; A45F 2005/002; A45F 2005/1013; A45F 2005/102; A45F 5/102

USPC ..... 426/108, 392; 220/23.2, 23.4, 758; 224/925, 580, 581, 429

See application file for complete search history.

(56) References Cited

U.S. PATENT DOCUMENTS

| | | | | | |
|---|---|---|---|---|---|
| 2,781,960 | A | * | 2/1957 | Dick | 294/27.1 |
| 3,219,233 | A | * | 11/1965 | Whiteford | 206/203 |
| 3,389,825 | A | * | 6/1968 | Whiteford | 220/23.4 |
| 3,490,576 | A | * | 1/1970 | Alessi et al. | 206/749 |
| 3,864,503 | A | * | 2/1975 | Steenolsen | 426/232 |
| D343,116 | S | | 1/1994 | Reger | |
| D343,573 | S | | 1/1994 | Shadrach | |
| 5,503,856 | A | * | 4/1996 | Hustad et al. | 426/108 |
| 6,062,622 | A | * | 5/2000 | Susman et al. | 294/149 |

(Continued)

FOREIGN PATENT DOCUMENTS

| | | | | |
|---|---|---|---|---|
| GB | 1182015 | | 2/1970 | |
| GB | 2 158 702 | * | 11/1985 | A45F 5/10 |
| GB | 2205302 A | | 12/1988 | |

*Primary Examiner* — Rena L Dye
*Assistant Examiner* — Chaim Smith
(74) *Attorney, Agent, or Firm* — RatnerPrestia

(57) ABSTRACT

A package for a food product comprises a container that has two sealed containment sections separated by a central portion located between the two containment sections. The container is adapted to be folded at the central portion, and a band that is separate from the container encircles the central portion. The circumference of the band provides a space between the band and the outer surface of the central portion that is large enough for a person's hand to be placed between the band and the central portion, and grasp the band. An assembled food product package comprises the package and two food product portions individually contained within each containment section. A method of making an assembled food product package comprises sealing two food product portions in the two containment sections and applying a band around the central portion.

19 Claims, 4 Drawing Sheets

(56) References Cited

U.S. PATENT DOCUMENTS

| | | | | |
|---|---|---|---|---|
| 6,113,959 | A * | 9/2000 | Ludwig | 426/281 |
| D445,311 | S | 7/2001 | Emonet | |
| D529,286 | S | 10/2006 | Limber | |
| D537,752 | S | 3/2007 | Goldberg | |
| D587,134 | S | 2/2009 | Caldwell | |
| D613,181 | S | 4/2010 | Friedland | |
| D617,654 | S | 6/2010 | Tawinsook | |
| 2007/0141283 | A1 * | 6/2007 | Hancock-Cooke et al. | B62J 9/00 428/35.7 |
| 2009/0145900 | A1 * | 6/2009 | Maroofian et al. | 220/200 |
| 2013/0068718 | A1 * | 3/2013 | Tai | 215/396 |

* cited by examiner

FOOD PRODUCT PACKAGING WITH A HANDLE AND METHODS FOR MAKING THE SAME

FIELD OF THE INVENTION

The present invention relates generally to food product packaging, and more particularly, to the packaging of poultry products.

BACKGROUND OF THE INVENTION

The primary function of food packaging, particularly meat packaging, is to surround the food product with a suitable protective material in order to protect the food product from undesirable impacts on quality, such as physical or microbiological alterations due to contamination. Packaging protects food products from various types of contamination, including contamination by dirt from surfaces and hands, contamination by micro-organisms (e.g., bacteria, molds, and yeasts), and contamination by toxic substances (e.g., chemicals). As consumers become increasingly concerned about health and food safety, new product packaging styles for meat and poultry are gradually becoming more important.

SUMMARY OF THE INVENTION

An embodiment of the present invention provides a package for a food product comprising a container comprising two sealed containment sections that are separated by a central portion located between the two containment sections. The container is adapted to be folded at the central portion, and a band that is separate from the container encircles the central portion. The circumference of the band is preferably large enough to function as a handle, i.e., to provide a space between the band and the outer surface of the central portion that is large enough for a person's hand to be placed between the band and the outer surface of the central portion, and to grasp the band.

Another embodiment of the present invention provides an assembled food package comprising a container comprising two sealed containment sections that are separated by a central portion located between the two containment sections. The container is folded at the central portion, and a band that is separate from the container encircles the central portion. Each of the containment sections individually contains a food product portion. For example, the food product may be a poultry product, such as chicken leg(s), chicken thigh(s), and/or chicken breast(s). Each containment section may further contain a marinade.

Another embodiment of the present invention provides a method of making an assembled food package comprising the steps of individually sealing food product portions in two containment sections of a container, wherein the two containment sections are separated by a central portion; and applying a band around the central portion. In exemplary embodiments, the method further comprises folding the central portion around a section of the band and applying an adhesive to the two containment sections, wherein the adhesive causes the two containment sections to adhere to one another.

BRIEF DESCRIPTION OF THE DRAWINGS

The invention may be further understood by reference to the drawings in which.

DETAILED DESCRIPTION OF THE INVENTION

The present invention provides a novel type of food product packaging that enables consumers to handle food products, particularly meat products, in a convenient and hygienic manner. In particular, a person can simply grasp the food package by a handle and avoid touching the portions of the package that contain the food product (e.g., meat product). The person can easily transport the package from one place to another. In exemplary embodiments, the user can remove a meat product from the package and place it directly on a grill, stove, or other cooking apparatus, without any intervening preparatory steps, such as marinating the meat product.

According to one aspect of the present invention, a package for a food product comprises a container comprising two sealed containment sections that are separated by a central portion located between the two containment sections. The container is adapted to be folded at the central portion and a band that is separate from the container encircles the central portion. According to one embodiment, the food product package comprises an adhesive that is bonded to the two containment sections and causes the two containment sections to adhere with each other.

The container preferably comprises a synthetic plastic material suitable for storing a food product. For example, the material may comprise one or more layers of polyethylene, polypropylene, polyvinylchloride, polyester, polyamide, nylon, polyvinylidenchloride, ethylenvinyl alcohol, or combinations thereof. The container preferably comprises plastic material(s) that are barriers to oxygen and water vapor. According to one embodiment, a food product is sealed, such as by heat sealing or ultra sonic sealing, by using suitable time, temperature and pressure settings to achieve adequate seals, and to sufficiently secure the food product(s) inside the containment sections without leaking.

Figure 1A:
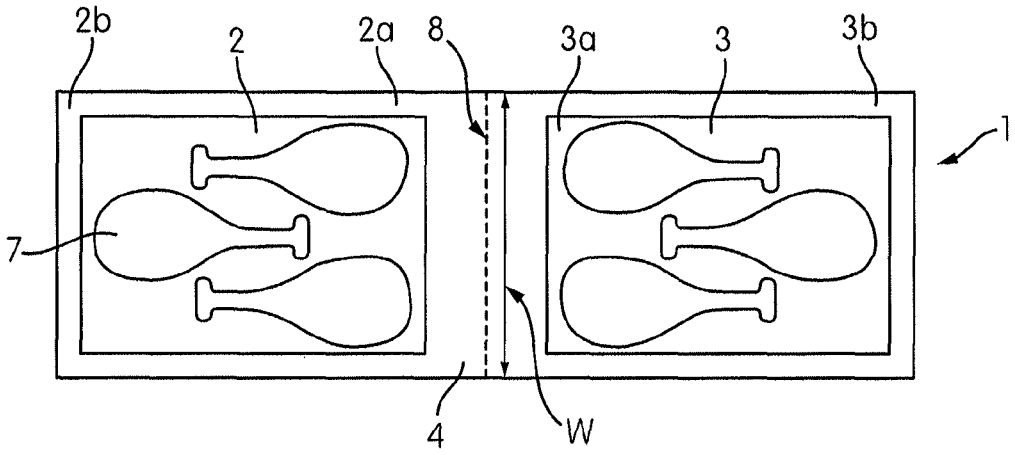
FIG. 1*a* depicts a top view of the container of a food product package containing food product portions according to one embodiment of the present invention.
Figure 1B:
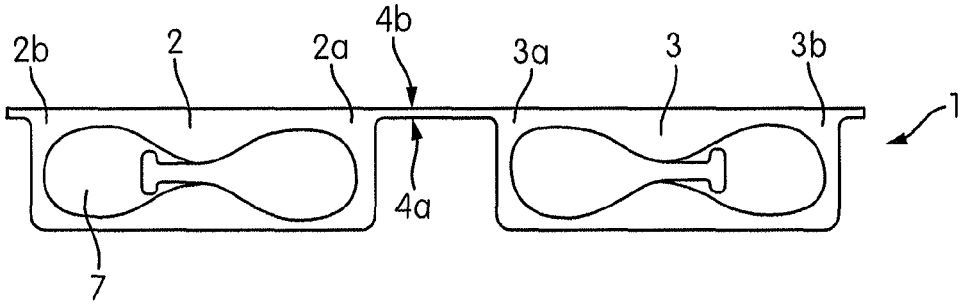
FIG. 1*b* depicts a side view of the container of a food product package containing food product portions according to one embodiment of the present invention.

In reference to the drawings, FIGS. 1*a* and 1*b* provide a top view and a side view, respectively, of an embodiment of the container 1 with a first sealed containment section 2 and a second sealed containment section 3 separated by a central portion 4. The central portion 4 is the region of the container 1 disposed between the first sealed containment section 2 and the second sealed containment section 3. The container 1 is adapted to be folded at the central portion 4, meaning that the material is sufficiently thin and pliable such that it can be folded. Alternatively, the central portion 4 might include a perforation 8 or a prefolded line for more easily being adapted to be folded, such as along the perforation or prefolded line. In general, the central portion 4 is sealed sufficiently to prevent any migration of any food product or marinade from one of the containment sections to the other. When a perforation 8 is included in the central portion 4, the central portion 4 is sealed between perforation 8 and each containment section 2, 3. Each of the two containment sections has a first end (2*a*, 3*a*) adjoining the central portion 4 and a second end (2*b*, 3*b*) remote from the central portion 4.

Figure 2:
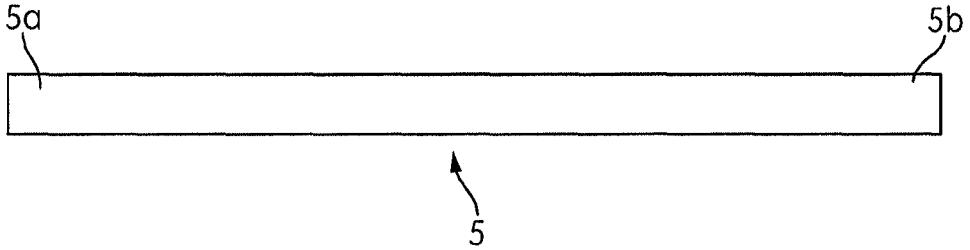
FIG. 2 depicts a top view of a band according to one embodiment of the present invention.

FIG. 2 provides a top view of an embodiment of the band 5, which comprises a material that is separate from the container (i.e., the band and container are separately formed structures). According to one embodiment, the band 5 comprises a strip of material (e.g., plastic material) that preferably has a substantially rectangular shape. The band may have a width of about 1 cm to about 5 cm, about 2 cm to about 4 cm, or preferably about 3 cm; and a length of about 15 cm to about 50 cm depending on the package width, or about 25 cm to about 35 cm, or preferably about 31 cm. As illustrated, for example, in FIG. 5, the two end portions 5*a*, 5*b* of the band (i.e., the portions of the band adjacent to the two respective ends) are adhered to each other (e.g., so that the band forms a circular or oval shape). The two end portions 5*a*, 5*b* of the band are preferably heat sealed or ultra sonically sealed together, or adhered to each other by a piece of tape or glue. Parts of the end portions 5*a*, 5*b* may overlap each other after they have been adhered to each other. Thus, after the end portions 5*a*, 5*b* have been adhered to each other, the resulting circumference of the band (i.e., the distance around the outside of the band) may be less than the original length of the band.

Figure 5:
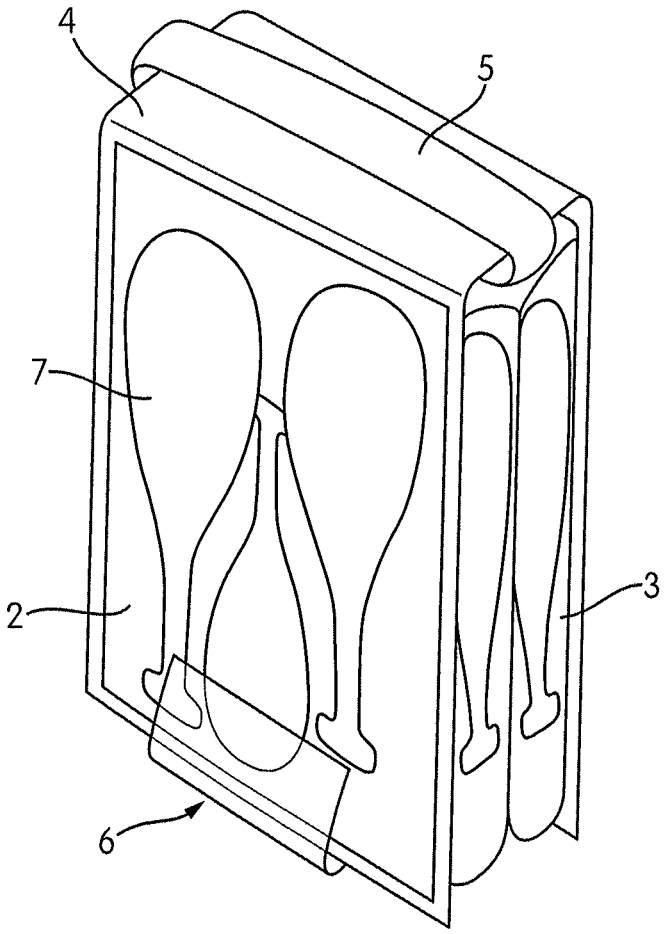
FIG. 5 depicts a perspective view of an assembled food product package containing two food product portions, according to one embodiment of the present invention.

An assembled food package is illustrated in FIG. 5. As shown therein, the container 1 is folded at the central portion 4 (preferably along the perforation 8 depicted in FIG. 1*a* or some other fold line), so that the two containment sections are side-by-side, and the band 5 encircles the central portion 4 with its two end portions 5*a*, 5*b* adhered to each other. The adhesive 6 is preferably located near the second ends (2*b*, 3*b*) of the two containment sections. For example, the adhesive 6 is preferably tape, most preferably transparent tape, that is adhered to the second ends of the two containment sections. In alternative embodiments, the adhesive may comprise a glue that adheres the two containment sections together.

The central portion of the container has an inner surface 4*a* (e.g., as illustrated in FIG. 1*b*), defined by the interior portion of the central portion, and an outer surface 4*b*. According to one embodiment, the central portion 4 of the container is folded along a perforation 8, so that the two portions of the inner surface 4*a* on either side of the fold line are folded toward each other. When the band is in contact with the inner surface 4*a* of the central portion 4 (e.g., as depicted in FIG. 5), the circumference of the band is sufficiently large to provide a space between the band and the outer surface 4*b* of the central portion. The space itself is sufficiently large for a person's hand to be placed between the band and the outer surface of the central portion, and to grasp the band.

For example, the longest distance between the band 5 at a single point at the center of the band and the outer surface 4*b* of the central portion, when the assembled package is lifted at that single point at the center of the band, may be between about 2 cm and about 10 cm when the band is in contact with the inner surface of the central portion (e.g., when a person grasps the band), preferably between about 3 cm to about 7 cm, most preferably between about 4 cm to about 5 cm. Alternatively, the band may have a circumference of between about 15 cm to about 50 cm, preferably between about 25 cm to about 35 cm, when the width W of the central portion (as shown in FIG. 1A) is about between about 10 cm to about 15 cm, preferably about 13 cm. Thus, the band functions as a handle that is adapted to be conveniently grasped by a user. The assembled food product package is sufficiently light in weight (e.g., between about 16 ounces to about 44 ounces, preferably between about 23 ounces to about 32 ounces) to be easily lifted by the handle (i.e., band) and carried in one hand.

According to preferred embodiments, the volume of each of the containment sections, as defined by the food product portion contained inside of each of them, causes each containment section to be wide enough to prevent the band from sliding down either of the containment sections. Thus, the circumference of the band is preferably large enough for a person's hand to be placed between the band and the outer surface of the central portion, but small enough to prevent the band from sliding down either of the containment sections when a food product portion is contained inside of them.

According to one aspect of the present invention, each of the two containment sections of the assembled food package individually contains a food product portion 7 (e.g., a perishable food, such as a meat, fruit, vegetable, etc.). According to preferred embodiments, the food product 7 in the two containment sections 2, 3 is a meat product selected from the group consisting of a poultry product, a beef product, a pork product, a fish product, and combinations thereof. In an exemplary embodiment, the food product in the two containment sections is a poultry product. For example, the poultry product may be selected from the group consisting of chicken legs, chicken thighs, chicken breasts, and combinations thereof. The containment sections may further contain a marinade (e.g., a sauce, dressing, or seasoned liquid), in addition to the meat (e.g., poultry) product. The marinade, which may contain oils, herbs, and/or spices to further flavor and/or tenderize the food product, enables the consumer to skip the step of marinating the food product after removing it from the package, as the food product has already been marinated inside the package.

According to another aspect of the invention, the assembled food package comprises a removable plastic covering (preferably transparent) which covers the containment sections and seals the food product inside. The plastic covering is preferably located on the top or outer surface of the containment sections (i.e., on the same surface as the outer surface 4*b* of the central portion). The plastic covering may comprise one sheet of plastic that covers both containment sections. Preferably, the plastic covering comprises two sheets of plastic, with one sheet covering each containment section. The plastic covering can be peeled off of the assembled food package to reveal the food product portion, so that the food product portion can then be removed from the package. For example, a user may lift a corner of the plastic covering located at the central portion, and peel the plastic covering back to reveal the food product portion; or the plastic covering may be cut away with a scissors or knife.

Figure 3:
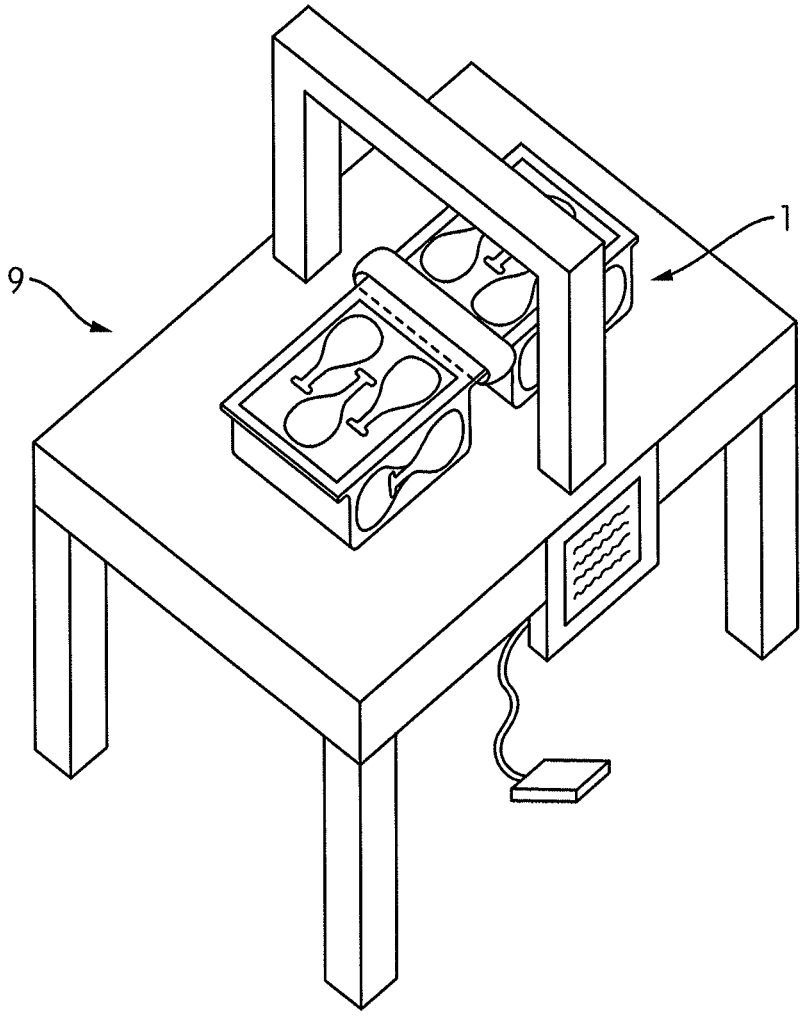
FIG. 3 depicts banding equipment used to apply a band to the food product package container according to one embodiment of the present invention.
Figure 4:
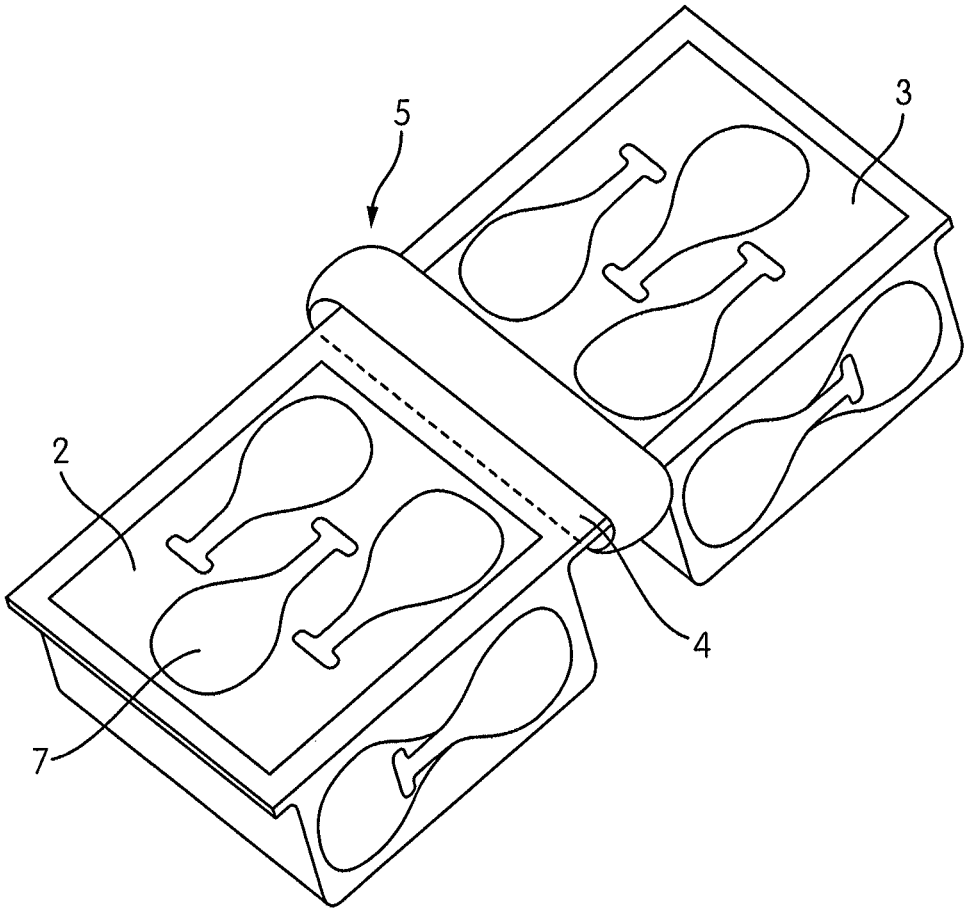
FIG. 4 depicts a perspective view of a package containing two food product portions.

According to another embodiment, a method of making an assembled food package of the present invention, as described above, comprises the steps of individually sealing food product portions 7 in two containment sections 2, 3 of a container, wherein the two containment sections are separated by a central portion 4 located between the two containment sections; and applying a band 5 around the central portion. The band 5 may be formed from a strip of material, in which case the step of applying the band preferably comprises sealing end portions 5*a*, 5*b* of the band together as the band is being applied around the central portion 4. It was discovered in accordance with the present invention that banding equipment 9 (an embodiment of which is depicted in FIG. 3), which is normally used for applying bands tightly around products in order to bundle them together, can be used to apply a band that encircles the package loosely enough to function as a handle.

According to another aspect of the invention, the method of making the assembled food package further comprises the step of folding the central portion (e.g., along the perforation 8) and around a section of the band. According to another embodiment, the method further comprises the step of applying the adhesive 6 to the two containment sections, wherein the adhesive causes the two containment sections to be in contact with each other. As discussed above, the adhesive is preferably applied near the second ends 2*b*, 3*b* of the two containment sections.

Although the present invention has been described in connection with specific embodiments, it should be understood that the invention as claimed should not be unduly limited to such specific embodiments. Indeed, various modifications and variations of the described compositions and methods of the invention will be apparent to those of ordinary skill in the art and are intended to be within the scope of the appended claims.

What is claimed is:

1. A package for a food product comprising:

a container comprising two sealed containment sections separated by a central portion located between the two containment sections, wherein the container is adapted to be folded at the central portion; and a band separate from the container and encircling the central portion, wherein the band is a single strip of material having two end portions adhered to each other by heat seal, ultrasonic seal, tape or glue.

2. The package according to claim 1, wherein the central portion has an inner surface and an outer surface, wherein when the band is in contact with the inner surface of the central portion and has a circumference sufficiently large to provide a space between the band and the outer surface of the central portion, the space is sufficiently large to permit a person's hand to be placed between the band and the outer surface of the central portion and to grasp the band.

3. The package according to claim 2, wherein the band has a circumference of between about 25 cm to about 35 cm and the width W of the central portion is between about 10 cm to about 15 cm.

4. The package according to claim 1, further comprising an adhesive bonded to the two containment sections to adhere the two containment sections with each other.

5. The package according to claim 4, wherein each of the two containment sections has a first end adjoining the central portion and a second end remote from the central portion, and the adhesive is located near the second ends of the two containment sections.

6. An assembled food package comprising:

the package according to claim 1, wherein the container is folded at the central portion; and two food product portions individually contained within the two containment sections.

7. The assembled food package according to claim 6, wherein the food product in the two containment sections is selected from the group consisting of a poultry product, a beef product, a pork product, a fish product, and combinations thereof.

8. The assembled food package according to claim 6, wherein the food product in the two containment sections is a poultry product.

9. The assembled food package according to claim 8, wherein the poultry product is selected from the group consisting of chicken legs, chicken thighs, chicken breasts, and combinations thereof.

10. The assembled food package according to claim 9, wherein the containment sections containing the poultry product further contain a marinade.

11. A method of making an assembled food product package comprising the steps of:

individually sealing food product portions in two containment sections of a container, wherein the two containment sections are separated by a central portion located between the two containment sections; and applying a band around the central portion by sealing end portions of the band together with heat seal, ultrasonic seal, tape or glue, wherein the band is a single strip of material.

12. The method according to claim 11 further comprising the step of folding the central portion around a section of the band.

13. The method according to claim 11 further comprising the step of applying an adhesive to the two containment sections, wherein the adhesive causes the two containment sections to adhere to each other.

14. The method according to claim 13, wherein each of the two containment sections has a first end adjoining the central portion and a second end remote from the central portion, and the method further comprises applying the adhesive near the second ends of the two containment sections.

15. The method according to claim 11, wherein the food product in the two containment sections is selected from the group consisting of a poultry product, a beef product, a pork product, a fish product, and combinations thereof.

16. The method according to claim 11, wherein the food product in the two containment sections is a poultry product.

17. The method according to claim 16, wherein the poultry product is selected from the group consisting of chicken legs, chicken thighs, chicken breasts, and combinations thereof.

18. The method according to claim 16, wherein the containment sections containing the poultry product further comprise a marinade.

19. An assembled food package comprising:

a container comprising two sealed containment sections separated by a central portion located between the two containment sections, wherein the container is folded at the central portion;

a band separate from the container and encircling the central portion;

two food product portions individually contained within the two containment sections, wherein the two food product portions are selected from the group consisting of poultry products, beef products, pork products, fish products, and combinations thereof; and a removable plastic covering which covers the containment sections and seals the two food product portions inside the containment sections, wherein the band is a single strip of material having two end portions adhered to each other by heat seal, ultrasonic seal, tape or glue, and wherein the volume of each of the containment sections, as defined by the food product portion contained inside, causes each containment section to be wide enough to prevent the band from sliding down either of the containment sections.

* * * * *